United States Patent [19]

Jonsson

[11] 4,383,909

[45] May 17, 1983

[54] PLATING APPARATUS

[76] Inventor: Göran Jonsson, Box 32, S-795 00, Rättvik, Sweden

[21] Appl. No.: 269,025

[22] PCT Filed: Oct. 1, 1980

[86] PCT No.: PCT/SE80/00235

§ 371 Date: Jun. 10, 1981

§ 102(e) Date: May 21, 1981

[87] PCT Pub. No.: WO81/01015

PCT Pub. Date: Apr. 16, 1981

[30] Foreign Application Priority Data

Oct. 10, 1979 [SE] Sweden ..... 7908395

[51] Int. Cl.[3] ..... C25D 17/00

[52] U.S. Cl. ..... 204/212; 204/215

[58] Field of Search ..... 204/200, 215, 212

[56] References Cited

U.S. PATENT DOCUMENTS 1,535,318 4/1925 Koehnline ..... 204/200
2,588,910 3/1952 Davis ..... 204/198
3,443,054 5/1969 O'Connor ..... 204/297 R
3,639,225 2/1972 Malkowski ..... 204/212

FOREIGN PATENT DOCUMENTS 2737664 2/1979 Fed. Rep. of Germany ..... 204/212

*Primary Examiner*—T. M. Tufariello
*Attorney, Agent, or Firm*—Zarley, McKee, Thomte, Voorhees & Sease

[57] ABSTRACT

An apparatus for plating workpieces by electrolytic treatment in several steps comprises means (2) to hold and rotate the workpiece (5), a plurality of electrodes, at least one of which being adapted, in each step, to be located at the workpiece by means of a holder (10), and means to supply, in each step, a certain electrolyte to the region of the rotating workpiece and the non-rotating electrode. A plurality of electrode holders (10) with associated electrodes are arranged on a common carrier (11), which is adjustably movable relative to the rotatable workpiece (5) to selectively locate an optional electrode holder with associated electrode(s) intended for the desired treatment step in an operative position relative to the rotatable workpiece. The carrier (11) is preferably rotatable.

9 Claims, 4 Drawing Figures

PLATING APPARATUS

TECHNICAL FIELD

The invention relates to an apparatus for plating workpieces by electrolytic treatment in a plurality of steps, comprising means to hold and rotate the workpiece, a plurality of electrodes, at least one of which being adapted, in each step, to be located at the workpiece by means of an electrode holder, and means to supply, in each step, a certain electrolyte to the region of the rotating workpiece and the non-rotating electrode, which during the treatment is connected to one pole of a source of direct current, the other pole of which is connected to the workpiece.

BACKGROUND ART

By means of this known apparatus, so called brush plating may be carried out, which is an electrolytic method for metallizing without need of immersing the workpiece in an electrolytic bath. In each treatment step, one or more electrodes, normally anodes, which typically are made of graphite and wound with an absorbing material, such as cotton or polypropylene wool or the like, are located adjacent the rotating workpiece, the absorbing material being in contact with the workpiece while the electrode proper may be located at a distance of e.g. 0.5 mms or less from the workpiece. The electrolyte is supplied to the area of the electrode and the workpiece and metals ions are deposited from the electrolyte on the surface of the workpiece adjacent to the electrode. In order to obtain a complete plating treatment, several steps are required. A first step may be degreasing, a second activation or pickling, a third deposition of a binding metal layer and a fourth deposition of the main metal layer. Each of said steps is carried out with a specific electrolyte and one or more specific electrodes.

Although it is possible with said apparatus to obtain high quality plating, there are nevertheless disadvantages as to the efficiency thereof. In practice, an electrode holder is provided to which a first electrode must be mounted for carrying out the first treatment step, i.e. degreasing. In addition, a hose or the like must be applied to the electrode to supply the degreasing electrolyte to the electrode. When the degreasing step is terminated, the electrode must be released from the holder and another electrode, e.g. an electrode for a pickling electrolyte, be mounted on the holder and in addition, another electrolyte container must be taken to the vicinity of the holder and connected to the pickling electrode by a hose. In an analogous manner, the treatment proceeds until the plating is completed by deposition of the main metal layer. In practice, such a plating operation may comprise four or more treatment steps and it is evident that the treatment as a whole is very laborious.

DISCLOSURE OF INVENTION

The object of the invention is to eliminate the disadvantage described above and enable a plating treatment as rapid and efficient as possible. In particular, the invention aims at enabling fully automatic plating of workpieces in long series.

According to the invention this object is obtained in that a plurality of electrode holders with associated electrodes are arranged on a common carrier, which is adjustably movable relative to said holding means and the rotatable workpiece to selectively locate an optional electrode holder with associated electrode(s) intended for the desired treatment step in an operative position relative to the rotatable workpiece. In this way, it is possible to rapidly and efficiently carry out several successive treatment steps by moving the carrier relative to the workpiece so that the holders in question with associated electrodes sequentially are brought into operative position relative to the workpiece without necessitating individual manipulating and mounting of electrodes.

It is preferred that the carrier is rotatable.

BRIEF DESCRIPTION OF DRAWINGS

With reference to the appended drawings, a more specific disclosure of an embodiment of the invention follows hereinbelow.

In the drawings

BEST MODE FOR CARRYING OUT THE INVENTION

Figure 1:
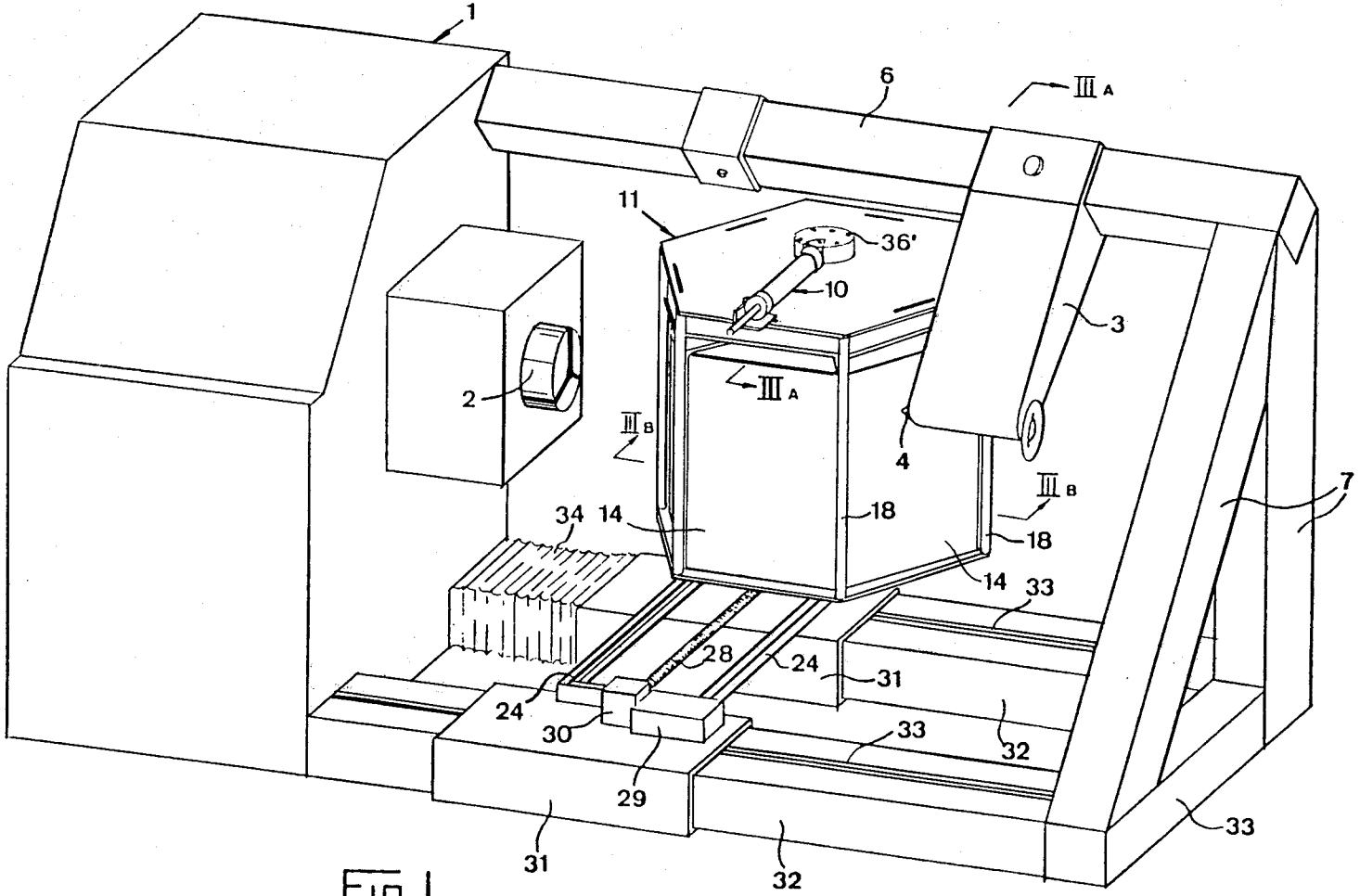
FIG. 1 is a perspective view of the apparatus, certain parts being omitted for clarity.

The apparatus illustrated in the drawings comprises a housing 1 containing suitable drive equipment to rotate a chuck 2. Workpieces to be plated by the apparatus may be clamped in the chuck. In order to support longer workpieces (see e.g. FIG. 2, wherein the workpiece is a long shaft 5) a tail stock 3 is provided having an adjustable dog 4. The tail stock 3 is displacable along a guide beam 6, which preferably is located above, suitably obliquely above the axis of rotation of chuck 2. The guide beam 6 is at one end connected to housing 1 and at the other end carried by two struts 7.

In order to carry out plating of a workpiece by electrolytic treatment in several steps, a plurality of electrodes 8, 9 (see FIG. 3) is required, at least one of which being adapted, in each step, to be located at the workpiece 5 by a holder generally denoted 10. A plurality of holders 10 with associated electrodes are provided on a common carrier 11, which is movable relative to the workpiece to enable an optional holder with associated electrode to be located in operative position relative to the workpiece.

Figure 2:
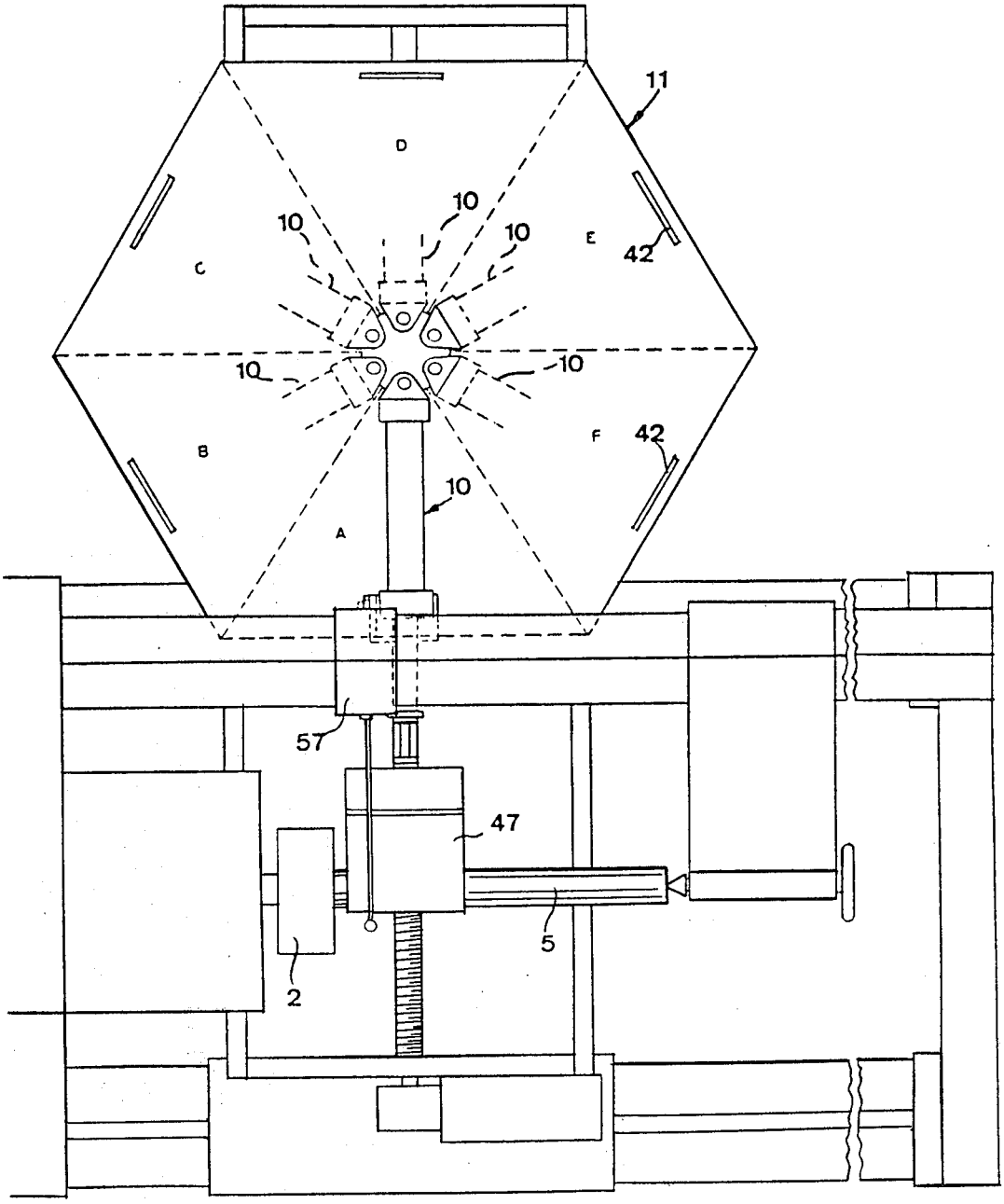
FIG. 2 is a top view of a portion of FIG. 1.

For clarity, only one holder 10 is partially shown in FIG. 1. In FIG. 2, a holder is completely illustrated with full lines while several other holders 10 are partially indicated with dashed lines. In the embodiment, the number of holders is 6 and it should in the following disclosure be kept in mind that all holders in practice are identical, In FIG. 3 a holder 10 is illustrated in its entirety while an additional holder is partially indicated.

The carrier 11 is in its entirety rotatable about a stationary shaft 12 which is surrounded by a sleeve portion 13 of the carrier. The carrier is hexagonal in plan view and adapted to carry six electrolyte containers 14 appearing in FIG. 1 but not illustrated in FIG. 3. The electrolyte containers 14 are as many as the electrode holders 10. The carrier 11 has an upper plate 15, a bottom plate 16 and an intermediate plate 17 located rather close to the upper plate 15. These three plates are interconnected by six vertical rods 18 arranged in the corners of carrier 11. The electrolyte containers 14 have a triangular form in plan view so that they, when they are inserted into carrier 11, form a configuration corresponding to the hexagonal shape of the carrier. The carrier 11 has no side walls so that each electrolyte container 14 is insertable into the carrier between two adjacent rods 18. Thus, the electrolyte containers are easily removable from and insertable into carrier 11 if another electrolyte would be required. Each electrolyte container has means, such as a pump and necessary hoses, to supply electrolyte to the region of the electrode(s) 8,9, which are carried by the holder 10 located above the electrolyte container 14 in question.

Figure 3:
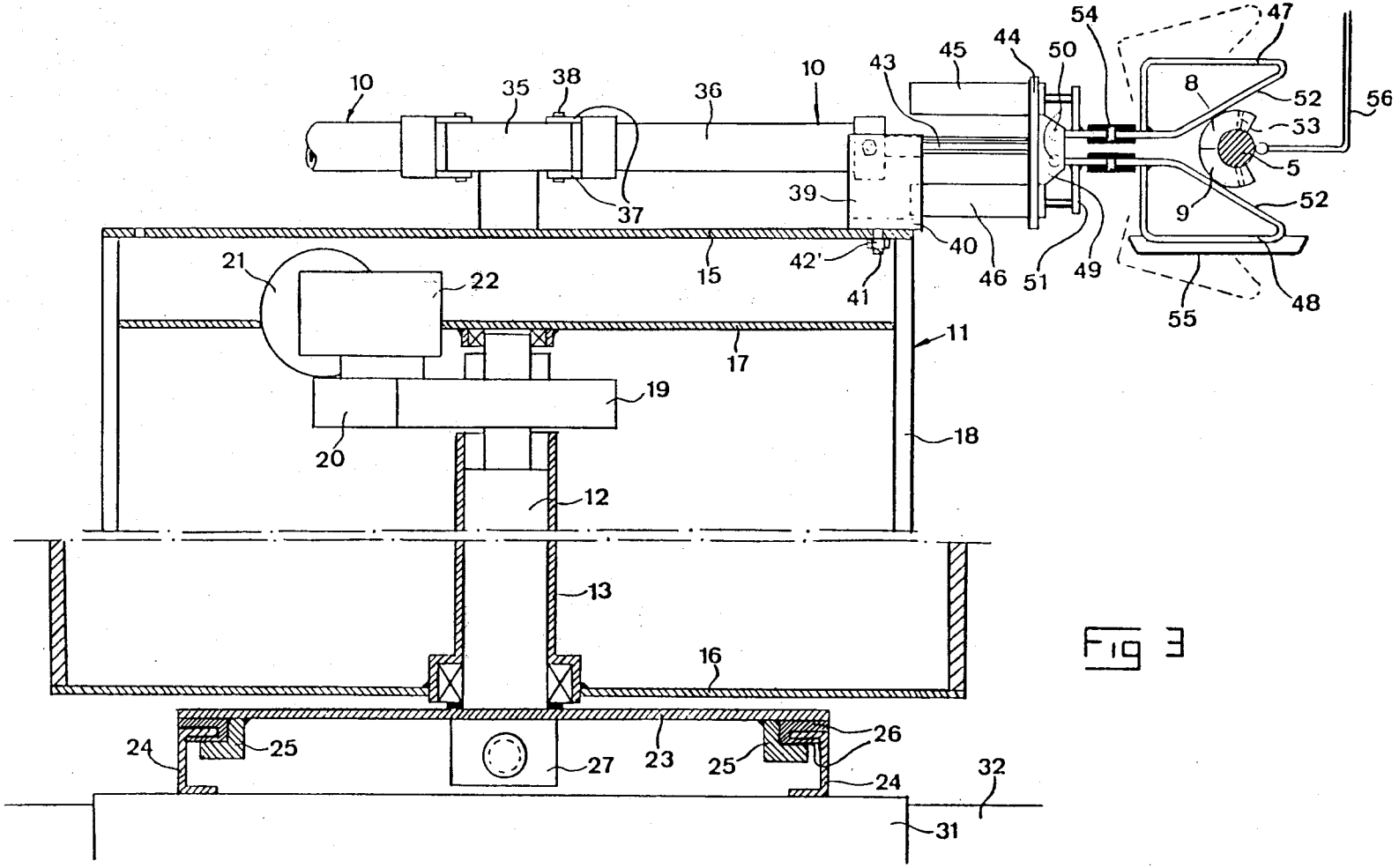
FIG. 3 is a composite cross section of a carrier of the apparatus, the upper part in FIG. 3 being a section along line III*a*—III*a* in FIG. 1 and the lower portion of FIG. 3 being a section along line III*b*—III*b* in FIG. 1.

As appears by FIG. 3, the sleeve 13 of the carrier is connected to the bottom plate 16. To enable rotation of carrier 11 about shaft 12, a schematically indicated transmission gear 19 is provided thereon, said gear meshing with another diagrammatically indicated gear 20 adapted to be driven by a motor 21 via a suitable transmission 22. The motor 21 and transmission 22 are connected to plate 17 and accompany carrier 11 in its rotation while gear 20 is rolling on the circumference of gear 19. Motor 21 is reversible to enable rotation of the carrier in either direction of rotation.

The carrier 11 is displacable perpendicular to the axis of rotation of the workpiece. This is obtained in that shaft 12 is rigidly connected to a plate 23 movable along guides 24 extending transversely to the axis of rotation of chuck 2. The guides 24 may e.g. have an U-shaped cross section while angle pieces 25 may be attached to plate 23. Suitable slide bearing elements 26 are provided between guides 24 on one hand and plate 23 and angle pieces 25 respectively on the other hand. To displace the carrier, plate 23 is rigidly connected to a nut 27 meshing with a screw 28 (FIG. 1) rotatable by a motor 29 via a transmission 30.

Furthermore, carrier 11 is displacable along the axis of rotation of chuck 2. The guides 24 are connected to two sleeves or slides 31, on one of which motor 29 and transmission 30 are attached. Said two slides 31 each runs on a guide 32, which are located spaced from each other and parallel to the axis of rotation of chuck 2. Guides 32 have the character of box girders and are at one end connected to housing 1 and at their other end interconnected by a cross piece 33 also connected to struts 7. A screw (not illustrated) is provided in each box girder 32. Each box girder has a longitudinal slot 33 and each slide has a projection (not illustrated) provided with a nut, said projection protruding down into the slot 33 so that the nut meshes with the screw. The screws in the box girders 32 are in a suitable manner driven in synchronism so that slides 31 are displaced completely parallel to avoid seizure. To eliminate entrance of pollutions into the interior of the box girders and between slides 31 and the box girders, bellows 34 are preferably provided, only one of which is indicated in FIG. 1. The bellow illustrated therein is attached at one end to the slide 31 and at its other end to housing 1 and surrounds partially the box girder 32. In analogy therewith, the other portions of the box girders 32 not covered by the slides 31 are surrounded by additional bellow sections. The same may also be valid in connection with guides 24 and screw 28. The bellows are particularly important since the apparatus operates with electrolytes which could be disastrous to the displacement component. It is evident that also the screws in box girders 32 are reversibly driven. As appears by FIGS. 1–3, the holders 10 of the carrier 11 are distributed about the circumference of the carrier and located in generally the same plane. A bracket 35 is connected to the upper plate 15 of carrier 11 and has six vertical holes 36'. Each holder 10 (FIG. 3) comprises a first piston-cylinder mechanism 36 to move the associated electrodes 8, 9 to and fro in a direction perpendicular to the axis of rotation of carrier 11. The piston-cylinder mechanism has two ears 37 engaging about a portion of bracket 35. A screw 38 projects through ears 37 and one of the holes 36' in bracket 35 so that piston-cylinder mechanism 36 is connected to bracket 35 but pivotable in a plane perpendicular to the axis of rotation of carrier 11. To secure the piston-cylinder mechanism in a desired pivotable position, an angle piece 39 is connected to the cylinder thereof, one flange 40 of said piece comprising a downwardly projecting screw 41 extending through a slot 42 in plate 15. A locking nut 42' enables securing of the piston-cylinder mechanism in a desired pivotal position. The piston rod 43 of piston-cylinder mechanism 36 is attached to a carrier plate 44 to which also the cylinders of two other piston-cylinder mechanisms 45, 46 are attached. Two holder members 47 and 48 are pivotably connected to ears 49 attached to carrier plate 44 so that holder members 47, 48 are pivotable about generally horizontal pivotal shafts 50. The holding members 47, 48 have each a projecting plate 51, to which the piston rod of the respective piston-cylinder mechanisms 45, 46 is connected in a pivotal manner (not illustrated) about shafts parallel to shafts 50. Each of the holding members 47, 48 have a sloping surface 52, on which the electrode 8, 9 is attached. In practice, the electrodes 8, 9 are usually anodes and this denomination will for simplicity be used hereinbelow. Each anode 8, 9 has in the embodiment a partially annular configuration to be able to partially surround a workpiece in the form of shaft 5. Each anode 8, 9 is in a way not illustrated adjustably connected to the holding member 47 and 48 respectively so that the anode may be moved and secured in a desired position on sloping surface 52.

The anodes 8, 9 are also readily removable from holding members 47, 48 to enable exchange of the anodes when a workpiece having another form is to be plated. The supply of electrolyte to anodes 8, 9 and shaft 5 occurs via hoses communicating with associated electrolyte containers 14. In practice, the electrolyte supply may occur via holes 53 in anodes 8, 9, said hoses being connected to said holes 53. Holding members 47, 48 are suitably manufactured from metal but each includes, in order to avoid disturbance of the plating, an electric interruption 54 obtained by an isolating piece of plastics material connecting the two spaced portions of each holding member. To collect excessive electrolyte, the lower holding member 48 carries a collecting vessel 55, which is provided with an outlet (not illustrated) communicating via a hose with the associated electrolyte container to return excessive electrolyte thereto. It is evident that the length of holding members 47, 48 perpendicularly to the plane of the drawing (FIG. 3) may be optional in dependence upon the length of workpiece 5 and the same applies for anodes 8, 9. Piston-cylinder mechanisms 36, 45 and 46 have in a known manner adjustment means (not illustrated) to enable accurate regulation of the stroke of the piston-cylinder mechanism. Furthermore, it is to be understood that piston-cylinder mechanism 36 in a known manner is provided with guide means to prevent piston rod 43 from rotating about its own axis.

In relation to FIG. 3, it is to be noted that anodes 8, 9 need not surround the entire circumference of workpiece 5. Anodes 8, 9 must, however, extend along the workpiece for the length thereof to be plated. In FIG. 2 it is illustrated that the holding members (only 47 is appearing) have an extent along workpiece 5, a shaft, which is considerably less than the length of the shaft. In this case also anodes 8, 9 have an equally great or smaller extent as or than the holding members and it is evident that electrolytic treatment and plating respectively only is obtained along the length of the workpiece being in contact or close to the anodes.

From the above, it appears that six different electrolytic treatment steps may be carried out with the apparatus according to the invention. These different treatment steps are carried out by different anode holders 10 and associated electrolyte containers 14. To simplify the following disclosure, carrier 11 is in FIG. 2 by dashed lines divided into six triangular parts having a size corresponding to each electrolyte container 14. Each of said triangular parts represents an electrolytic treatment step and the different parts are designated with the letters A–F. In practice, the treatment step A may constitute degreasing by means of a degreasing electrolyte in the associated electrolyte container. The treatment steps B, C and D enable activation treatments, such as pickling, and the associated electrolyte containers contain different activation electrolytes. The treatment step E may serve to apply on the workpiece a primer or binder layer of a metal providing the best adhesion of the material of which the workpiece is manufactured. Thus, there is in the associated electrolyte container a suitable metal electrolyte. Finally, the treatment step F may serve to apply on the workpiece the main metal layer and in the associated electrolyte container there is a suitable metal electrolyte for this purpose. The last mentioned electrolyte may be selected to obtain e.g. a good wear resistance, corrosion protection or other desirable characteristics.

The apparatus according to the invention may e.g. be used to repair cylindrical or conical surfaces on tools and machine parts when they are subject to e.g. tolerance errors, wear, scores, corrosion or impact marks. It is often possible to plate directly to desired tolerance without subsequent machining but in case of irregular wear, subsequent machining in the form of turning, grinding, milling or polishing of the plating is normally required.

The apparatus according to the invention is used as follows. Reference is made to the case according to FIGS. 2–3 in which a shaft 5 is to be plated. If the entire envelope surface of shaft 5 is to be plated, the anodes 8, 9 must, as pointed out previously, have a length corresponding to the length of shaft 5 and this is valid for the anodes on all holders 10 to be used in the plating operation. In a typical plating operation e.g. five treatment steps (say A, B, D, E and F) may be required. A particular advantage with the apparatus according to the invention is that it makes it possible to automatically plate large series of uniform workpieces, which e.g. may have been manufactured to under-size. In such a fully automatic operation the apparatus is adapted to be controlled via a computer having predetermined treatment programs or sequences. In order to carry out plating of a series of shafts automatically, the actual treatment step must first be adjusted, unless advanced automatic sensing eliminates the need for manual adjustment. The manual adjustment, is, however, carried out in such a way that after having provided holding members 47 and 48 of the holders 10 to be used with suitable anodes 8, 9 adapted to the shaft, the stroke of the piston-cylinder mechanisms 36, 45 and 46 is adjusted so that anodes 8, 9 are located, when the piston rods of the piston-cylinder mechanisms are extended, in a correct position relative to a shaft 5 clamped in chuck 2. Before this adjustment of the strokes of the piston-cylinder mechanisms is carried out, the position of carrier 11 along guides 24 and 32 must have been adjusted and secured. When now the necessary adjustment operations have been carried out, an automatic plating operation may be initiated by operating the mentioned computer control equipment. With the chosen treatment sequence, carrier 11 is initially rotated to the position according to FIG. 2 so that treatment step A may be carried out. The shaft 5 clamped in chuck 2 is rotated and piston-cylinder mechanism 36 expands and pushes the holding members 47, 48 towards shaft 5. When the piston rod of piston-cylinder mechanism 36 has reached the extreme position, piston-cylinder mechanisms 45, 46 are automatically activated so as to pivot holding members 47, 48 from the inactive position indicated in FIG. 3 with dashed lines towards a position closely adjacent shaft 5. Thereafter, a degreasing electrolyte is pumped from electrolyte container 14 in step A to anodes 8, 9 and is introduced through holes 53 into contact with shaft 5. When this degreasing operation is terminated, holding members 47, 48 are pivoted away by piston-cylinder mechanisms 45, 46, whereupon piston-cylinder mechanism 36 retracts the holding member. Carrier 11 is then rotated so as to locate treatment step B opposite shaft 5 and a treatment step with an activation electrolyte is carried out in analogy with the degreasing operation. In continued analogy with the degreasing operation, treatment is then carried out with step C and an additional activation electrolyte, step E involving deposition of a binder layer on shaft 5 from a metal electrolyte and finally step F involving the final metallization with the main metal layer. During treatment by steps E and F the thickness of the deposited metal layer may be sensed by a measuring device 56 diagrammatically indicated in FIG. 3 and being of a known kind using optical or electroinductive measuring of the thickness of the plating layer. Measuring device 56 may be adapted to automatically terminate plating steps E and F when required layer thickness is reached. Measuring device 56 may be connected to a sleeve 57 movable along beam 6.

As has been described above, a large number of uniform workpieces may be rapidly and efficiently plated with the apparatus according to the invention. Obviously, also shorter series of workpieces or individual workpieces may be plated more rapidly and efficiently as has hitherto been the case.

Since carrier 11 is not only rotatable but also displacable in two directions perpendicular to each other, a great flexibility is obtained and workpieces with markedly different shapes may be plated. Electrolyte containers 14 may easily be exchanged for readjustment between different types of plating operations and this is also due for anodes 8, 9 and their holding members 47, 48.

Figure 4:
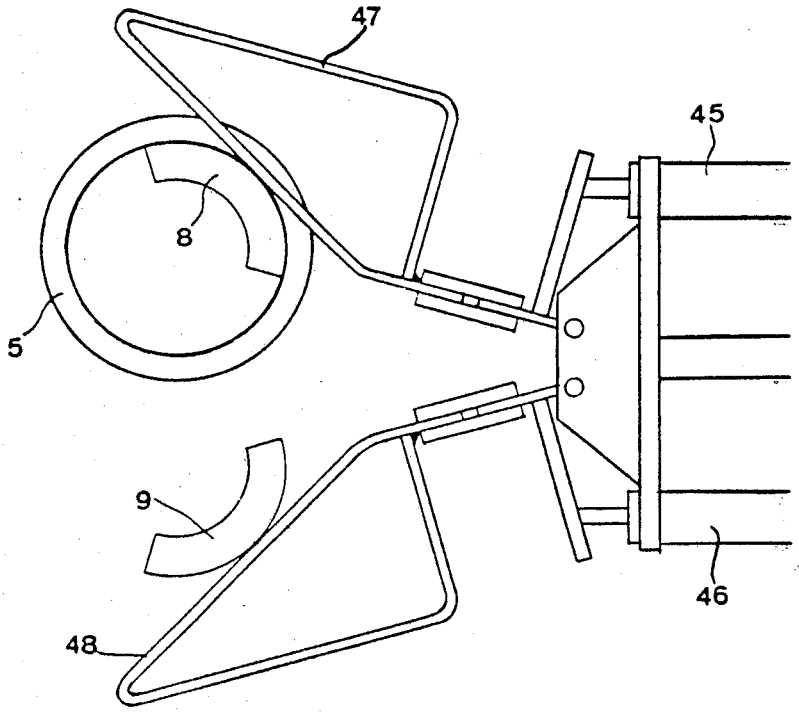
FIG. 4 is an enlarged detail view illustrating an electrolytic treatment step on the interior surface of a hollow cylinder.

In FIG. 4 it is, as an example, illustrated how the internal surface of a hollow cylindrical workpiece 5 is subjected to electrolytic treatment. In this case, piston-cylinder mechanism 46 of holding member 48 is switched off so that it continuously is in the retracted position. The holding member 47 on the other hand is illustrated with its associated anode applied on the internal surface of cylinder 5. The anode 8 must of course in this case protrude sidewardly relative to holding member 47.

The invention is of course in no way limited to the embodiment described above. Thus, carrier 11 may comprise more as well as fewer (e.g. two) than six holders 10 and electrolyte containers 14. Carrier 11 must not necessarily be rotatable but may instead comprise a plurality of holders disposed side by side, which holders may be brought into alignment with a workpiece by straightly linear displacement of the carrier. Finally, manual displacement means are conceivable instead of piston-cylinder mechanisms 36, 45 and 46.

I claim:

1. An apparatus for plating workpieces by electrolytic treatment in a plurality of steps, comprising, means to hold and rotate the workpiece, a plurality of electrodes, at least one of which being adapted in each step to be located at the workpiece by means of an electrode holder, and means to supply, in each step, a certain electrolyte to the region of the rotating workpiece and the non-rotating electrode, which during the treatment is connected to one pole of a source of direct current, the other pole of which is connected to the workpiece, characterized in that a plurality of said electrode holders with associated ones of said electrodes are arranged on a common carrier, which is adjustably movable relative to said holding means and the rotatable workpiece to selectively locate an optional electrode holder with associated electrode(s) intended for the desired treatment step in an operative position relative to the rotatable workpiece, said holder and electrode(s) being adapted to remain on the carrier during the treatment step, and in that said carrier is provided with electrolyte containers in a number equal to the number of said electrode holders, each container being associated with means to supply electrolyte to the region of one of said electrode holders.

2. Apparatus according to claim 1, characterized by said carrier being rotatable about an axis perpendicular to the axis of rotation of the workpiece.

3. Apparatus according to claim 1, characterized in that said carrier is movable along the axis of rotation of the workpiece.

4. Apparatus according to any one of claims 1, 2 or 3, characterized in that said carrier is movable at an angle to the axis of rotation of the workpiece.

5. Apparatus according to claim 2, characterized in that said holders of said carrier are distributed about the circumference of said carrier and located generally in a common plane perpendicular to the axis of rotation of said carrier.

6. Apparatus according to claim 1, characterized in that each of said holders is adapted to move its associated electrode toward and away from the workpiece.

7. Apparatus according to claim 6, characterized in that each of said holders comprises at least one first operating means to move said electrode associated with said holder to an initial position rather close to the workpiece and at least one second operating means to move said electrode from the initial position to an operative position closely adjacent the workpiece.

8. Apparatus according to claim 7, characterized in that said first operating means defines a linear path of movement, while said second operating means actuates said electrode about a pivotal axis perpendicular to said path.

9. Apparatus according to any one of claims 1, 2 or 3, characterized by means for securing said electrode to its holder in an adjustable and removable manner.

* * * * *